US006621912B2

(12) United States Patent
Sugiyama et al.

(10) Patent No.: US 6,621,912 B2
(45) Date of Patent: Sep. 16, 2003

(54) SPEAKER

(75) Inventors: Shigeru Sugiyama, Sizuoka (JP); Hajime Kitamura, Sizuoka (JP); Naohiro Fujinami, Shizuoka (JP); Yoshio Imahori, Shizuoka (JP); Hitoshi Yamashima, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 154 days.

(21) Appl. No.: 09/791,872

(22) Filed: Feb. 26, 2001

(65) Prior Publication Data

US 2001/0017928 A1 Aug. 30, 2001

(30) Foreign Application Priority Data

Feb. 25, 2000 (JP) ..... 2000-050198

(51) Int. Cl.[7] ..... H04R 25/00
(52) U.S. Cl. ..... 381/407; 381/400
(58) Field of Search ..... 381/430, 420, 381/407, 400, 403, 405, 410

(56) References Cited

U.S. PATENT DOCUMENTS 1,962,012 A 6/1934 Grassmann
2,392,143 A * 1/1946 Graham
4,118,605 A 10/1978 Kobayashi
5,150,419 A * 9/1992 Kizak et al.
5,699,439 A 12/1997 Geisenberger et al.

FOREIGN PATENT DOCUMENTS

GB 2 055 014 A 2/1981

OTHER PUBLICATIONS

Japanese Abstract of JP A 01 215200, Aug. 29, 1989 Mitsubishi Electric Corporation.
Japanese Abstract of JP A 56 126399, Oct. 3, 1981, Mitsubishi Electric Corporation.
Japanese Abstract of JP A 57 148498, Sep. 13, 1982, Seiko Instr & Electronics Ltd.

* cited by examiner

*Primary Examiner*—Sinh Tran
(74) *Attorney, Agent, or Firm*—Sughrue Mion, PLLC

(57) ABSTRACT

Fixing of a voice coil (16) to a diaphragm (12) is performed by caulk-fixing a coil supporting member (26) to the diaphragm (12) and by fit-supporting the voice coil (16) by the coil supporting member (26). Hereby, the voice coil 16 is physically fixed to the diaphragm (12) and its fixing strength is heightened. The caulk-fixing is performed by subjecting a caulking projection of the coil supporting member (26) to a plastic deformation thereby to provide a caulk-fixed portion (26*b*), whereby deformation injurious to the acoustic property does not occur in the diaphragm (12). Further, the fit-supporting is performed by interposing a flange portion (16*a*1) formed at an upper end portion (16*a*) of the voice coil (16) between an engaging portion (26*a*) of the coil supporting member (26) and a central flat portion (12*b*) of the diaphragm (12) and holding it by them from upper and lower sides.

6 Claims, 10 Drawing Sheets

SPEAKER

BACKGROUND OF THE INVENTION

1. Field of the Invention

The present invention relates to a dynamic speaker, and particularly to a structure for fixing a voice coil to a diaphragm in the dynamic speaker.

2. Description of the Related Art

As one type of a speaker, a dynamic speaker has been known heretofore. The dynamic speaker, as disclosed in, for example, JP-A-6-178390, comprises generally a diaphragm, a voice coil of which one end portion is fixed to the diaphragm, and a magnetic circuit unit defining a cylindrical magnetic gap for placing the other end portion of the voice coil therein.

As the fixing structure of the voice coil to the diaphragm, the following structure is known, as disclosed in the JP publication. One end portion 2*a* of a voice coil 2 having an I-shaped coiling section as shown in FIG. 10A is bonded and fixed to a diaphragm 4.

However, in the speaker having such a fixing structure, since the large bonding area cannot be obtained, the fixing strength is insufficient. Accordingly, there is fear that the voice coil 2 peels off and separates from the diaphragm 4 during being used. Particularly, in case that the speaker is mounted on an automobile or the like, since it is used under environment where considerable vibration and shock load are applied, the voice coil 2 is easier to separate from the diaphragm.

On the other hand, as shown in FIG. 10B, in case that the coiling thickness of the voice coil 2 is set large, the relatively large bonding area between its one end portion 2*a* and the diaphragm 4 can be obtained, whereby the sufficient fixing strength can be obtained.

However, in this case, since a width of a cylindrical magnetic gap G of a magnetic circuit unit 6 becomes large, there is a problem that electroacoustic conversion efficiency of the speaker degrades. Further, the larger the coiling thickness of the voice coil 2 is, the larger the weight of the voice coil 2 becomes, whereby the large load acts on the bonding surface. Therefore, there is also a problem that separation preventing effect cannot be obtained as expected.

SUMMARY OF THE INVENTION

The invention has been made in consideration of these circumstances, and an object of the invention is to provide a speaker in which separation of a voice coil can be prevented without worsening acoustic characteristic of a dynamic speaker.

In order to achieve the object, a predetermined coil supporting member is provided in the invention.

Namely, there is provided a speaker comprising:

a diaphragm;

a magnetic circuit unit defining a cylindrical magnetic gap;

a voice coil having a first portion fixed to the diaphragm, and a second portion placed in the cylindrical magnetic gap; and a coil supporting member, fixed to the diaphragm, for supporting the first portion of the voice coil, wherein the coil supporting member is caulked and fixed to the diaphragm by subjecting a caulking projection formed in the coil supporting member to a plastic deformation.

The "diaphragm", "voice coil" and "magnetic circuit unit" are not particularly limited in their concrete constitution such as their material, shapes, and the like as long as they can be used as components of the dynamic speaker.

The "coil supporting member", as long as it supports the first portion of the voice coil in a state where it is caulked and fixed to the diaphragm by a plastic deformation of its caulking projection, is not particularly limited in its concrete constitution such as its material, its shape, a supporting method of voice coil, or the like. Further, the "caulking projection", as long as the coil supporting member can be caulked and fixed to the diaphragm by its plastic deformation, is not particularly limited in its concrete constitution such as its shape, its size, the number of the projections, arrangement, or the like.

As described in the constitution, in the speaker according to the invention, the coil supporting member that supports the first portion of the voice coil is caulked and fixed to the diaphragm by subjecting the caulking projection formed in the coil supporting member to the plastic deformation. Therefore, the following effects that act on the invention can be obtained.

Namely, since the voice coil is supported by the coil supporting member at the first portion thereof, it is not only directly fixed to the diaphragm by bonding but also indirectly fixed to the diaphragm through the coil supporting member. Therefore, the sufficient fixing strength of the voice coil in relation to the diaphragm can be obtained even if the coiling thickness of the voice coil is not made large and the large bonding area is not obtained between the first portion of the voice coil and the diaphragm unlike the conventional art. Hereby, since it is not necessary to expand the width of the cylindrical magnetic gap in the magnetic circuit unit, it is possible to prevent electroacoustic conversion efficiency of the speaker from lowering.

Further, since the coil supporting member is caulked and fixed to the diaphragm by the plastic deformation of its caulking projection, the diaphragm itself does not receive the excessive load at the caulking time. Accordingly, by providing the coil supporting member, it is possible to prevent deformation injurious to the acoustic property from occurring in the diaphragm.

As described above, according to the invention, the separation of the voice coil can be prevented without worsening acoustic property of the speaker.

In the constitution, in case that the fixing strength of the voice coil to the diaphragm is sufficiently obtained by only the support of the coil supporting member, the direct fixing between the voice coil and the diaphragm by bonding may be omitted. In this case, since the bonding step or the like required conventionally when the voice coil is fixed to the diaphragm can be eliminated, the working efficiency in manufacture of speaker can be heightened greatly.

In the constitution, in case that a flange portion protruding inward in the radial direction is formed at one end portion of the voice coil, and an engaging portion that engages with this flange portion is formed in coil supporting member, the voice coil can be surely supported by the coil supporting member, so that the fixing strength of the voice coil to the diaphragm can be sufficiently heightened. Therefore, the direct fixing between the voice coil and the diaphragm by bonding can be readily omitted.

In this case, the "flange portion" and "engaging portion", as long as the coil supporting member can support the voice coil by their engaging, are not particularly limited in the concrete constitution such as a sectional shape.

The concrete method of subjecting the caulking projection of the coil supporting member to the "plastic deformation is"

not particularly limited. For example, the plastic deformation can be also performed by a mechanical method such as cold caulking. Further, in case that the coil supporting member is composed of a member made of synthetic resin, a method can be also adopted, in which the caulking projection is subjected to a heat deformation by applying the ultrasonic vibration to the caulking projection.

By adopting the method in which the caulking projection is subjected to the heat deformation by applying the ultrasonic vibration to the caulking projection, even in case that a speaker is a small-sized speaker and a caulking projection of its coil supporting member is very small, caulk-fixing can be performed readily and reliably.

In this case, since the diaphragm itself is not subject to caulk-fixing, it is not necessary entirely to take application of material of two members to fusion-bonding into consideration like a case where the two members are fusion-bonded by an ultrasonic wave. Accordingly, there is not restriction on selection freedom of material of the diaphragm, because the method in which the caulking projection is subjected to the heat deformation by applying the ultrasonic vibration is adopted.

As described above, the concrete constitution of the coil supporting member is not particularly limited. Further, in case that this coil supporting member is composed of an annular member, the caulking projections are formed at plural places in the coil supporting member at a predetermined distance in the circumferential direction, and plural through-holes into which these caulking projections are inserted are formed in the diaphragm; caulk-fixing can be performed in a state where the coil supporting member is exactly positioned in the predetermined position of the diaphragm.

As described above, in case that the flange portion protruding inward in the radial direction is formed at the first portion of the voice coil and the engaging portion that engages to this flange portion is formed in coil supporting member, the voice coil can be reliably supported by the coil supporting member. Therefore, also in case that fixing of the coil supporting member to the diaphragm is performed by other fixing methods than caulk-fixing, for example, by bonding, the fixing strength of the voice coil in relation to the diaphragm can be heightened in some degree.

DETAILED DESCRIPTION OF THE PRESENT INVENTION

The invention will be described below with reference to the accompanying drawings.

Figure 1:
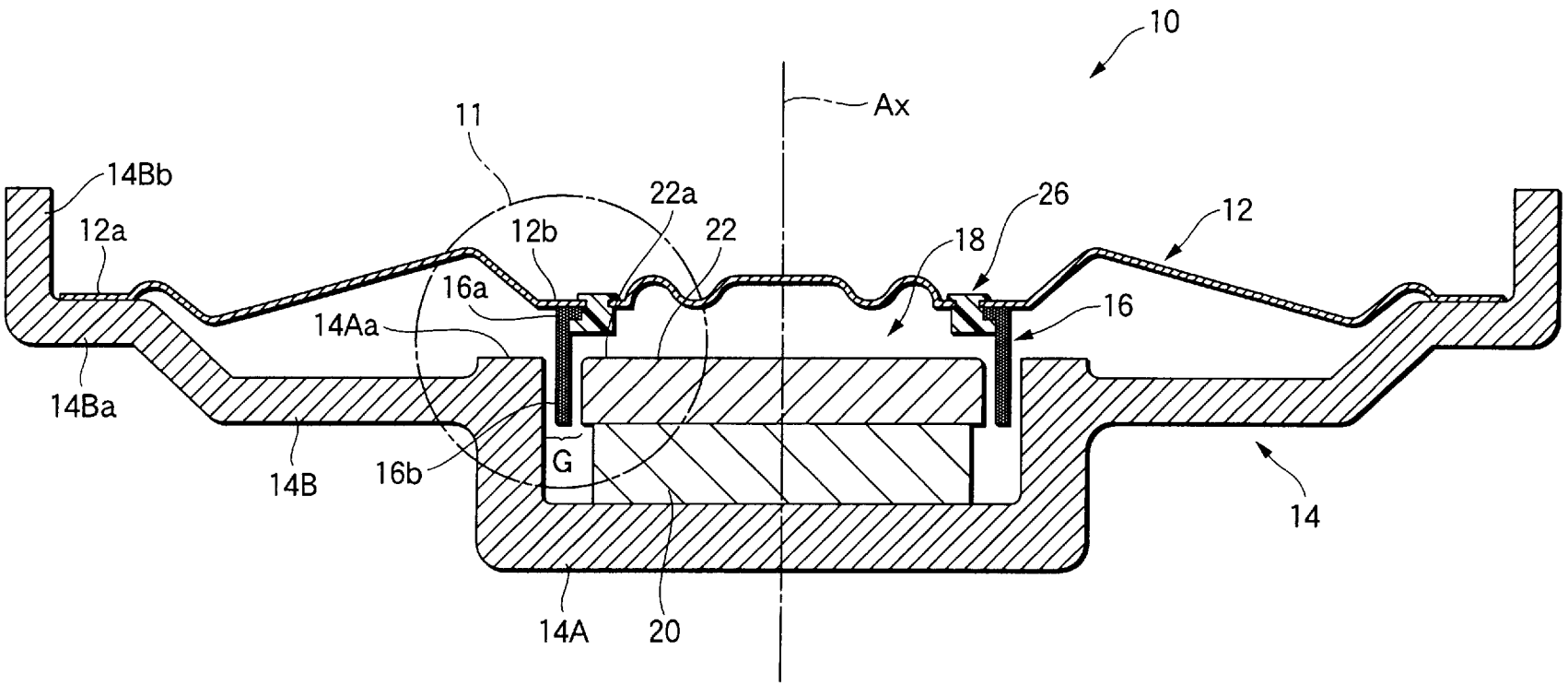
FIG. 1 is a side sectional view of a speaker according to an embodiment for carrying out the invention, in which the speaker faces upward.
Figure 2:
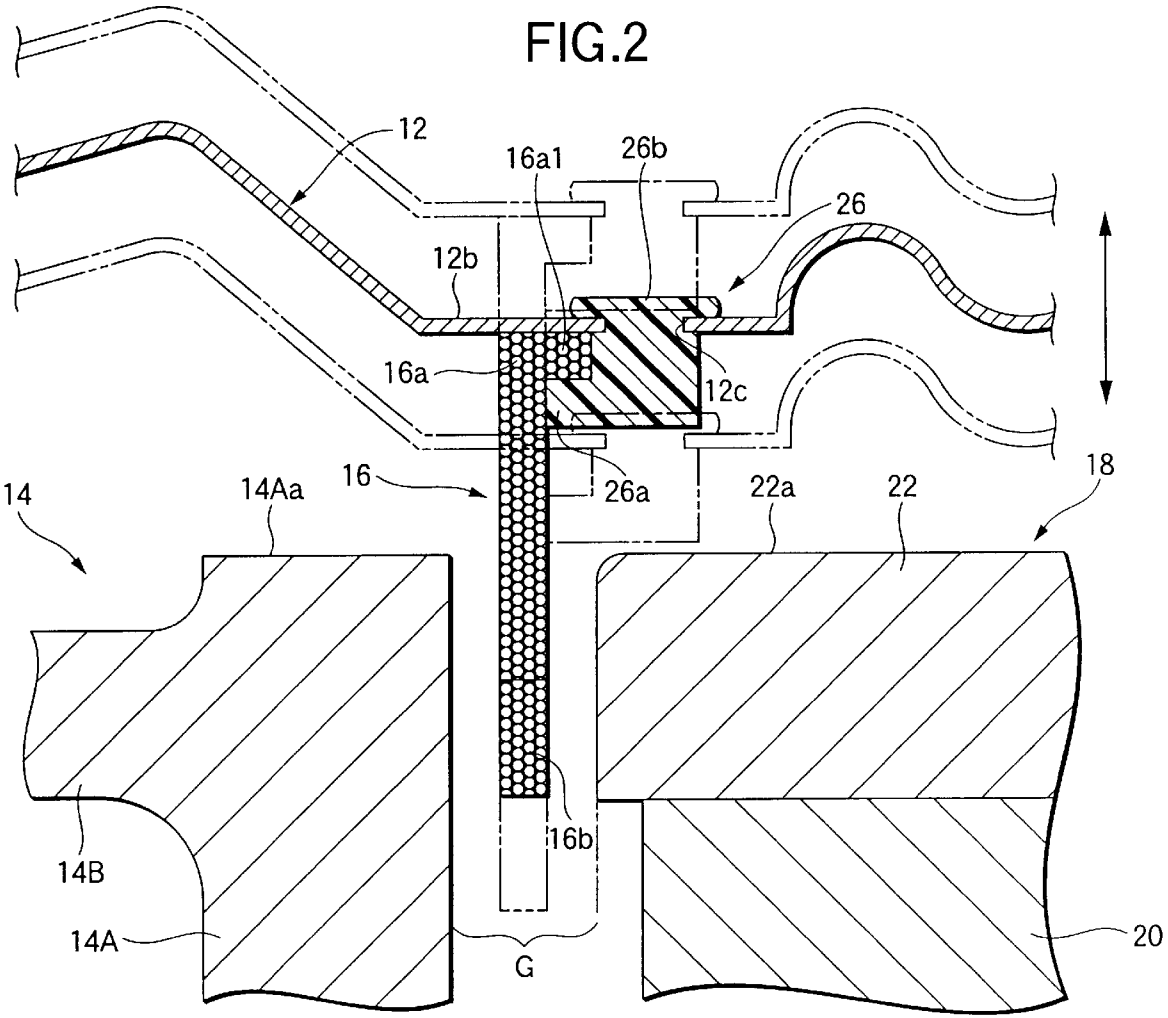
FIG. 2 is a detailed diagram of an II portion in FIG. 1.

FIG. 1 is a side sectional view of a speaker 10 according to the embodiment of the invention, in which the speaker faces upward, and FIG. 2 is a detailed diagram of a II portion in FIG. 1.

As shown in FIG. 1, the speaker 10 is a dynamic speaker comprising a diaphragm 12, a frame 14, a voice coil 16 and a magnetic circuit unit 18. The speaker 10 is a small-sized speaker having an outer diameter of about 30 mm, and used as, for example, a generator of alarm sound or the like, which is mounted on a base plate in a state where it has been stored in a case (not shown) and which is loaded on an automobile or the like.

The diaphragm 12 is a member having a plurality of unevenness formed concentrically, and it is formed by applying heat press molding to a synthetic resin film. A peripheral edge flat portion 12*a* of the diaphragm 12 and a central flat portion 12*b* are located on the same horizontal annular plane.

The frame 14 is a steel member, and comprises a bottomed cylinder portion 14A located in the center and an annular mounting portion 14B that extends outward in the diameter direction from the vicinity of the upper end portion on the outer surface of this bottomed cylinder portion 14A. In the mounting portion 14B, a plurality of through-holes (not shown) is formed at a predetermined interval in the circumferential direction. And, at the peripheral edge portion of the mounting portion 14B, there are formed an annular flat portion 14Ba located above an upper end surface 14Aa of the bottomed cylinder portion 14A and a flange portion 14Bb extending upward from this annular flat portion 14Ba.

The diaphragm 12, at its peripheral edge flat portion 12*a,* is bonded and fixed to the annular flat portion 14Ba of the mounting portion 14B of the frame 14. This bond-fixing is performed in a state where the diaphragm 12 and the frame 14 are arranged so as to be concentric with each other in relation to a central axis Ax of the speaker 10.

The voice coil 16 is arranged so as to be concentric with the diaphragm 12, and its upper end portion 16*a* (one end portion) is fixed to the central flat portion 12*b* of the diaphragm 12. The fixing structure will be described later.

The magnetic circuit unit 18 includes the bottomed cylinder portion 14A of the frame 14, a magnet 20 and a steel yoke 22. Both of the magnet 20 and yoke 22 are formed in the shape of a disk, placed on a bottom surface of the bottomed cylinder portion 14*a* in this order so as to be concentric with each other, and bonded and fixed to the frame 14. The magnetic circuit unit 18 is so set that an upper end surface 22*a* of the yoke 22 has the substantially same height as the upper end surface 14Aa of the bottomed cylinder portion 14A, and a cylindrical magnetic gap G is formed, between the outer surface of the yoke 22 and the inner surface of the bottomed cylinder portion 14*a,* with the same width in whole. And, in the cylindrical magnetic gap G, a lower portion 16*b* (the other end portion) of the voice coil 16 is placed.

In the embodiment, the voice coil 16 is fixed to the diaphragm 12 through a coil supporting member 26.

Namely, as shown in FIG. 2, at the upper end portion 16*a* of the voice coil 16, a flange portion 16*a*1 protruding inward in the radial direction is formed. On the other hand, at a lower end portion of the coil supporting member 26, an engaging portion 26*a* is formed, which engages with the flange portion 16*a*1 of the voice coil 16. Further, at an upper end portion of the coil supporting member 26, a caulk-fixed portion 26*b* is formed, which is caulked to be fixed to the central flat portion 12*b* of the diaphragm 12. And, the flange portion 16*a*1 of the voice coil 16 are interposed between the engaging portion 26*a* of the coil supporting member 26 and the central flat portion 12*b* of the diaphragm 12 and held by them from upper and lower sides, whereby the voice coil 16 is fixed to the diaphragm 12.

The diaphragm 12, the voice coil 16, and the coil supporting member 26 move up and down, when the speaker is driven, in a range shown by a two-dots chain line in FIG. 2. The height of the coil supporting member 26 is so set that clearance is provided in some degree between the coil supporting member 26 and the upper end surface 22*a* of the yoke 22 even when the vibration occurs with the maximum amplitude. And, by thus setting the height of this coil supporting member 26, the usual speaker driving is performed without hindrance. Further, when the vibration occurs with abnormally large amplitude over the maximum amplitude, the coil supporting member 26 comes into contact with the upper end surface 22*a* of the yoke 22 to restrict the vibration, whereby it is prevented that the diaphragm 12 or the like breaks.

Figure 3:
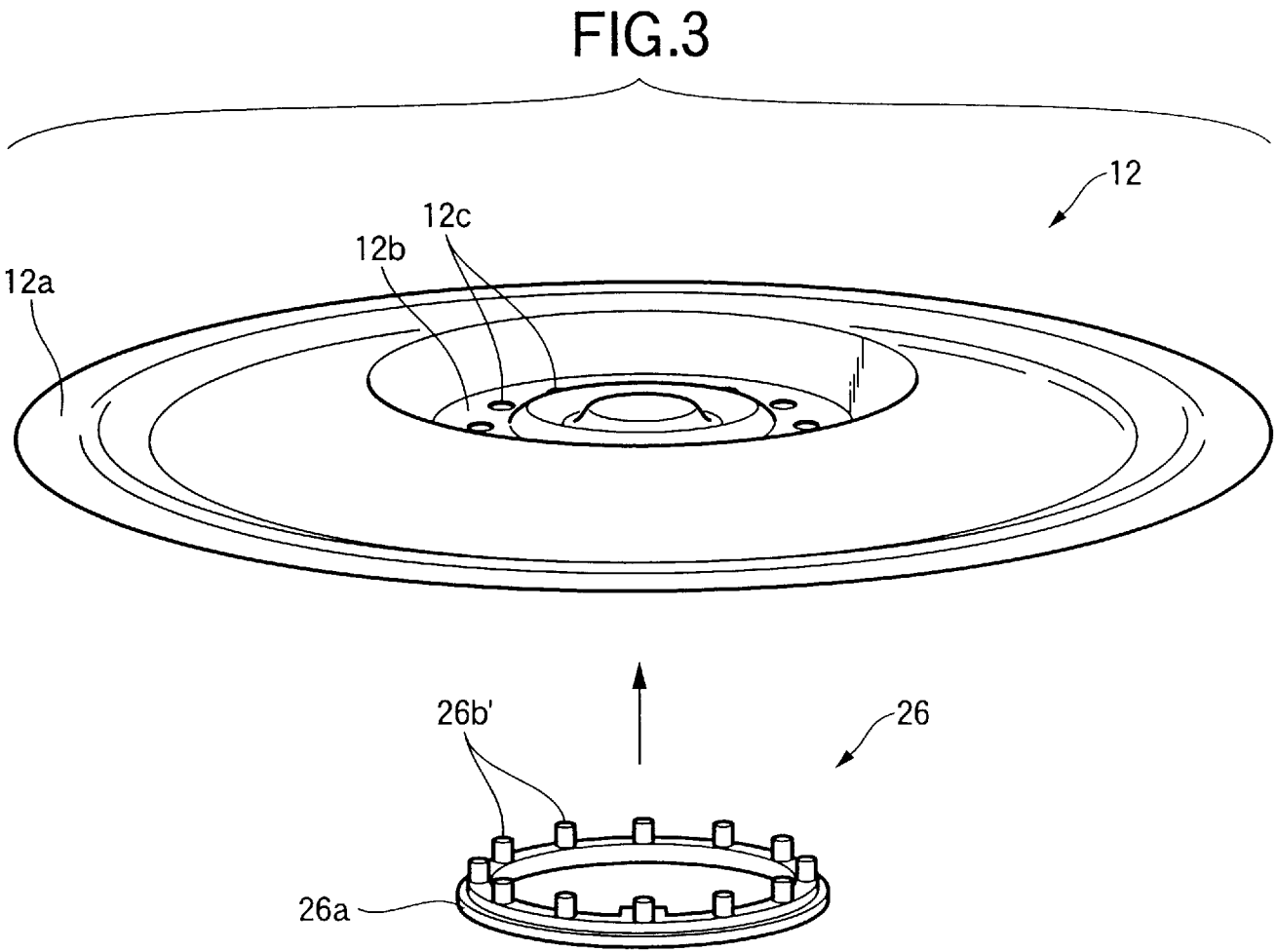
FIG. 3 is a perspective view showing a state before a coil supporting member is caulked and fixed to a diaphragm in the embodiment.

FIG. 3 is a perspective view showing a state before the coil supporting member 26 is caulked and fixed to the diaphragm 12.

As shown in FIG. 3, the coil supporting member 26 includes an annular member made of synthetic resin, and functions as a bobbin. At a peripheral surface of the supporting member 26, a different-in-level portion is so formed that a lower half has a large diameter, and its lower half constitutes the engaging portion 26*a*. Further, column-shaped caulking projections 26*b*' are formed at twelve points on the upper end surface of this coil supporting member 26 at an interval of 30° in the circumferential direction.

On the other, in the central flat portion 12*b* of the diaphragm 12, twelve through-holes 12*c* into which the caulking projections 26*b*' are inserted are formed. Each of these through-holes 12*c* is a circular hole having the substantially same diameter as that of the caulking projection 26*b*'.

After each caulking projection 26*b*' of the coil supporting member 26 is inserted from the lower side into each through-hole 12*c* of the diaphragm 12, the coil supporting member 26 is caulked and fixed to the diaphragm 12 by subjecting each caulking projection 26*b*' to a plastic deformation. In this case, the plastic deformation of each caulking projection 26*b*' is performed by applying ultrasonic vibration to the caulking projection 26*b*' and subjecting the caulking projection 26*b*' to a heat-deformation.

Figure 4B:
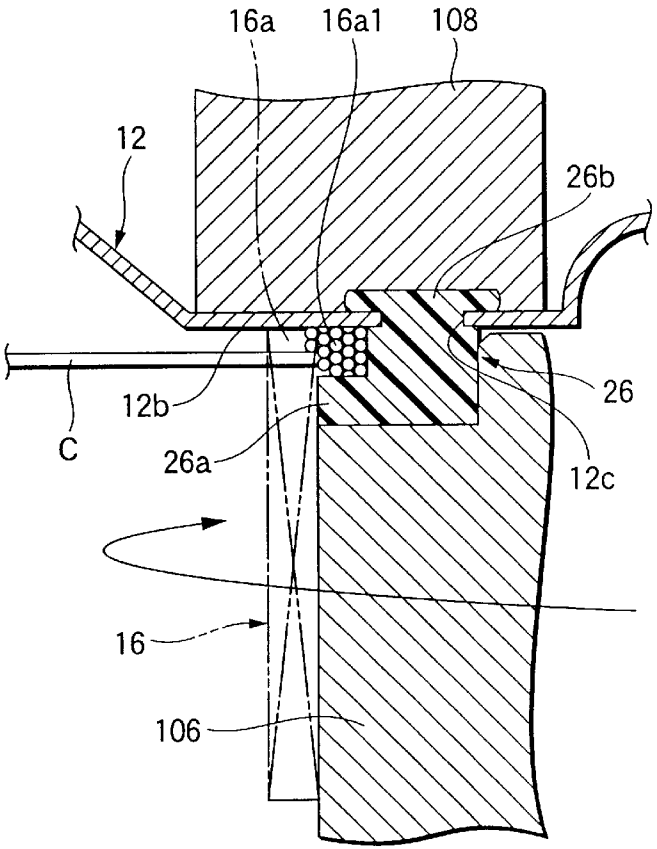
FIGS. 4A and 4B are main portion side sectional views each showing a step for fixing a voice coil to the diaphragm in the embodiment.
Figure 4A:
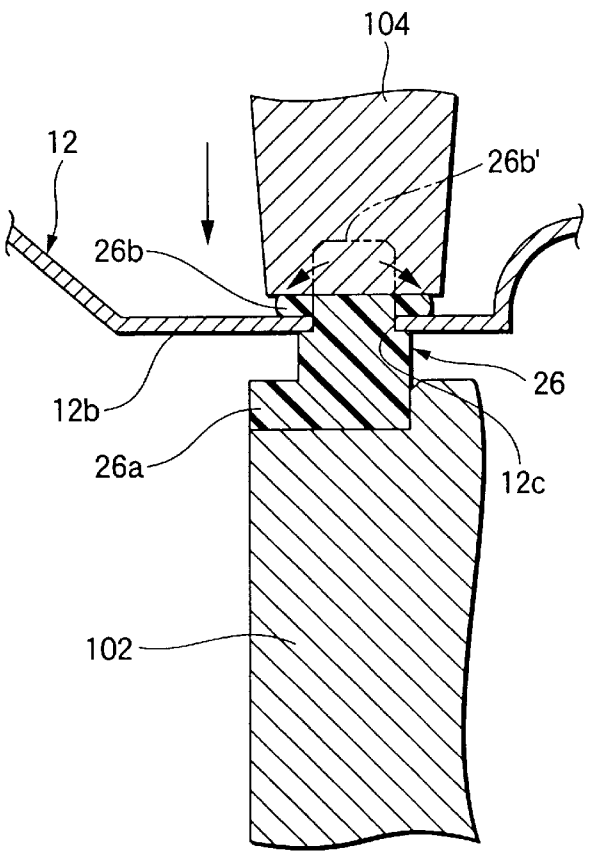

Specifically, as shown in FIG. 4A, after the coil supporting member 26 is set in a caulking receiver jig 102, the diaphragm 12 is set to the coil supporting member 26 in such a manner that each caulking projection 26*b*' is inserted into each through-hole 12*c*. Under this state, a horn 104 of an ultrasonic vibration device is brought into contact with the upper end portion of the caulking projection 26*b*' to apply the ultrasonic vibration to the caulking projection 26*b*', whereby the caulking projection 26*b*' is subjected to the heat deformation, so that a caulk-fixed portion 26*b* is formed.

The thus formed caulk-fixed portion 26*b* holds the diaphragm 12 between the caulk-fixed portion 26*b* and the body portion of the coil supporting member 26 at the surrounding portion of the through-hole 12*c*, whereby the coil supporting member 26 is firmly fixed to the diaphragm 12.

The voice coil 16 is formed by coiling a coil wire C around the coil supporting member 26 fixed to the diaphragm 12.

Specifically, as shown in FIG. 4B, the coil supporting member 26 fixed to the diaphragm 12 is set to a coiling receiver jig 106 having the same outer diameter as that of its engaging portion 26*a*. Thereafter, the coil supporting member 26 and the central flat portion 12*b* of the diaphragm 12 are pressed from the upper side by a coiling press jig 108. In this state, a leading end portion of the coil wire C is hung on a small-diameter recess portion adjacent the engaging portion 26*a* of the coil supporting member 26, and the coiling receiver jig 106 and the coiling press jig 108 are rotated about the central axis Ax (refer to FIG. 1) and the coil wire C is moved up and down in the predetermined range, whereby the coil wire C is wound on the outer surfaces of the coil supporting member 26 and the coiling receiver jig 106 thereby to form the voice coil 16 having the coiling section of the L-shape in which the flange portion 16*a*1 is formed at the upper end portion 16*a*.

As the coil wire C, a wire coated with fusion-bonding synthetic resin is used. And, immediately before the coiling, hot wind is blown against the wire C in order to melt the coating, whereby the wound wire C is fusion-bonded mutually to form the voice coil 16. Further, the coiling number of the coil wire C is set to an even number (for example, the coiling number at the upper end portion 16*a* is eight and the coiling number at other portions is four), so that both leading and trailing ends of the wire are drawn out from the upper end portion 16*a* of the voice coil 16.

As described above, the speaker 10 according to the embodiment has the coil supporting member 26 caulked and fixed to the diaphragm 12, and the engaging portion 26*a* of the coil supporting member 26 and the central flat portion 12*b* of the diaphragm 12 holds the flange portion 16*a*1 formed at the upper end portion 16*a* of the voice coil 16 between them, whereby the voice coil 16 is fixed to the diaphragm 12. Therefore, the following effects can be obtained.

Namely, the voice coil 16 is fixed to the diaphragm 12 physically by engaging with the coil supporting member 26. Therefore, its fixing strength can be improved greatly in comparison with the case where the upper end portion 16*a* of the voice coil 16 is fixed directly to the diaphragm 12 by bonding like the conventional art.

Further, though the coiling thickness at the upper end portion 16*a* of the voice coil 16 is large because the flange portion 16*a*1 is formed there, since other portions than the upper end portion 16*a* have the usual coiling thickness, it is not necessary to expand the width of the cylindrical magnetic gap G in the magnetic circuit unit 18, whereby without lowering electroacoustic conversion efficiency of the speaker 10, the effects can be obtained.

Further, the coil supporting member 26, since its caulking projection 26*b*' is subjected to the plastic deformation thereby to provide the caulk-fixed portion 26*b*, is caulked and fixed to the diaphragm 12. Therefore, the diaphragm 12 itself does not receive the excessive load at the caulk-fixing time. Accordingly, by providing the coil supporting member 26, it is possible to prevent deformation injurious to the acoustic property from occurring in the diaphragm 12.

As described above, according to the invention, the separation of the voice coil can be prevented without worsening the acoustic property of the speaker.

Accordingly, even in case that the speaker 10 according to the embodiment is used under environment where considerable vibration and shock load act, for example, even in case that the speaker 10 is used as a speaker mounted on an automobile, it can be sufficiently fit for use.

In the embodiment, the upper end portion 16*a* of the voice coil 16 is not directly fixed to the diaphragm 12 by bonding. Therefore, the bonding step or the like conventionally required when the voice coil 16 is fixed to the diaphragm 12 is not necessary, so that the working efficiency in manufacture of the speaker 10 can be heightened greatly.

Further, in the embodiment, the coil supporting member 26 functions also as the amplitude limiting means. Therefore, it is possible to prevent the diaphragm 12 or the like from breaking due to occurrence of the vibration with the abnormal amplitude.

Further, in the embodiment, the coil supporting member 26 includes the annular member and the caulking projections 26*b*' are formed at the plural places in its circumferential direction, while the plural through-holes 12*c* into which these caulking projections 26*b*' are inserted are formed in the diaphragm 12. Therefore, caulk-fixing can be performed in a state where the coil supporting member 26 is exactly positioned in the predetermined position of the diaphragm 12. Particularly, in this embodiment, since the twelve caulking projections 26*b*' and the twelve through-holes 12*c* are formed at the interval of 30°, the fixing strength between the coil supporting member 26 and the diaphragm 12 can be made extremely high.

Further, in the embodiment, the plastic deformation of the each caulking projection 26*b*' is performed by applying the ultrasonic vibration to the caulking projection 26' thereby to subject the caulking projection to the heat deformation. Therefore, though each caulking projection 26' is a very small projection, the caulk-fixing can be readily and reliably performed. In this case, since the diaphragm 12 itself is not subject to caulk-fixing, it is not necessary to select the material to be suitable for fusion-bonding for the diaphragm 12. Accordingly, there is no restriction on selection freedom of material of the diaphragm 12.

Figure 5B:
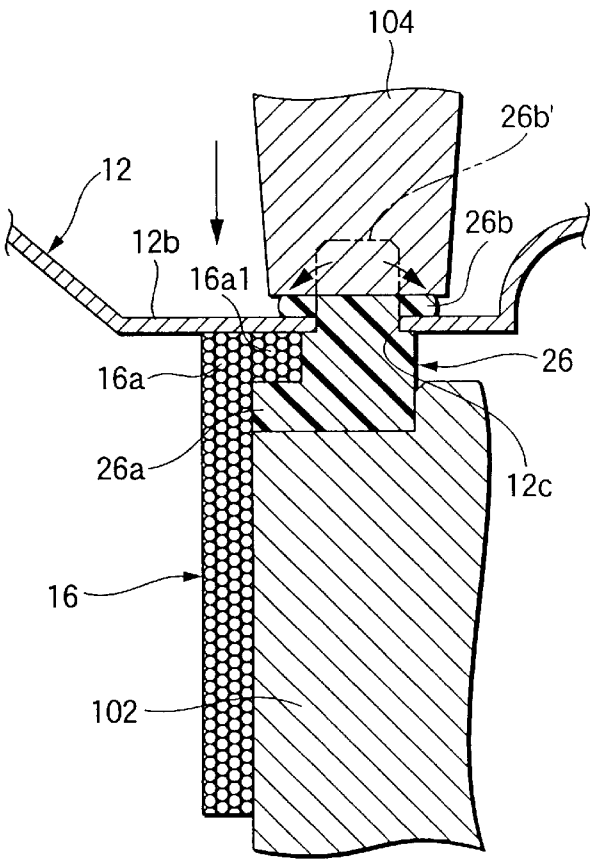
FIGS. 5A and 5B are diagrams similar to FIGS. 4A and 4B, which show a first modification of the embodiment.
Figure 5A:
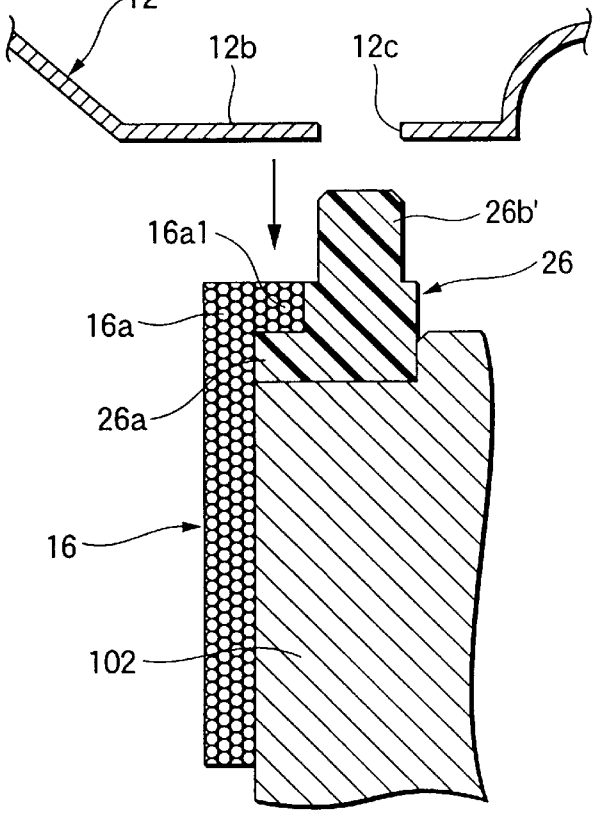

FIGS. 5A and 5B are diagrams similar to FIGS. 4A and 4B, which show a first modification of the embodiment.

Also, in the first modification, it is similar to the embodiment that a voice coil 16 is fixed to a diaphragm 12 through a coil supporting member 26. However, the first modification is different from the embodiment in a manufacturing method for realizing this fixing.

Namely, as shown in FIG. 5A, the voice coil 16 is previously formed and the coil supporting member 26 is set to a caulking receiver jig 102 together with this voice coil 16. Thereafter, the diaphragm 12 is set to the coil supporting member 26 in such a manner that each caulking projection 26*b*' is inserted into each through-hole 12*c*. Under this state, as shown in FIG. 5B, a horn 104 of an ultrasonic vibration device is brought into contact with the upper end portion of the caulking projection 26*b*' to apply the ultrasonic vibration to the caulking projection 26', whereby the caulking projection 26*b*' is subjected to a heat deformation, so that a caulk-fixed portion 26*b* is formed.

Also, in a case where the manufacturing method in the first modification is adopted, the similar effects to those in the embodiments can be obtained.

Figure 6:
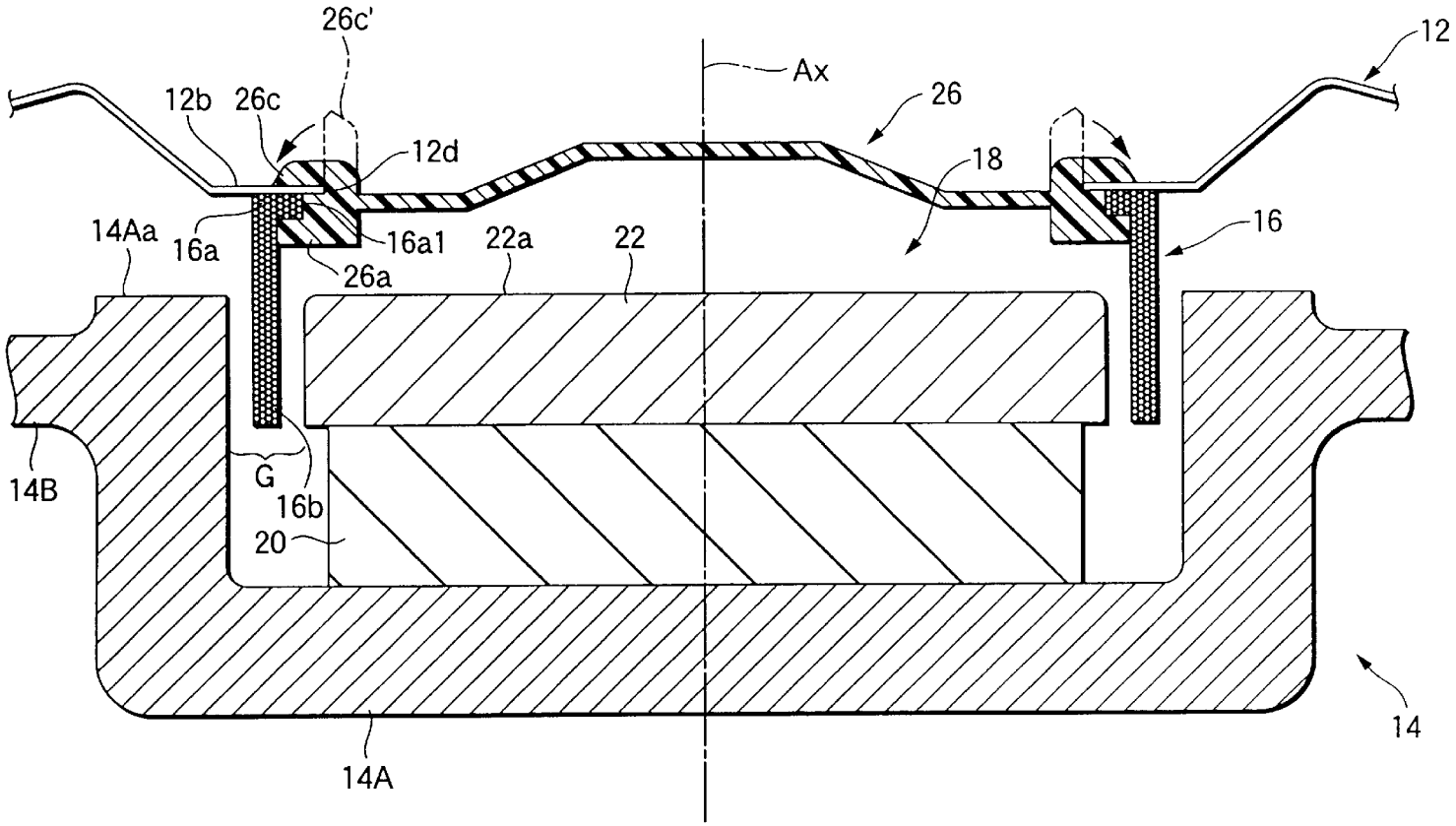
FIG. 6 is a main portion side sectional view showing a second modification of the embodiment.
Figure 7:
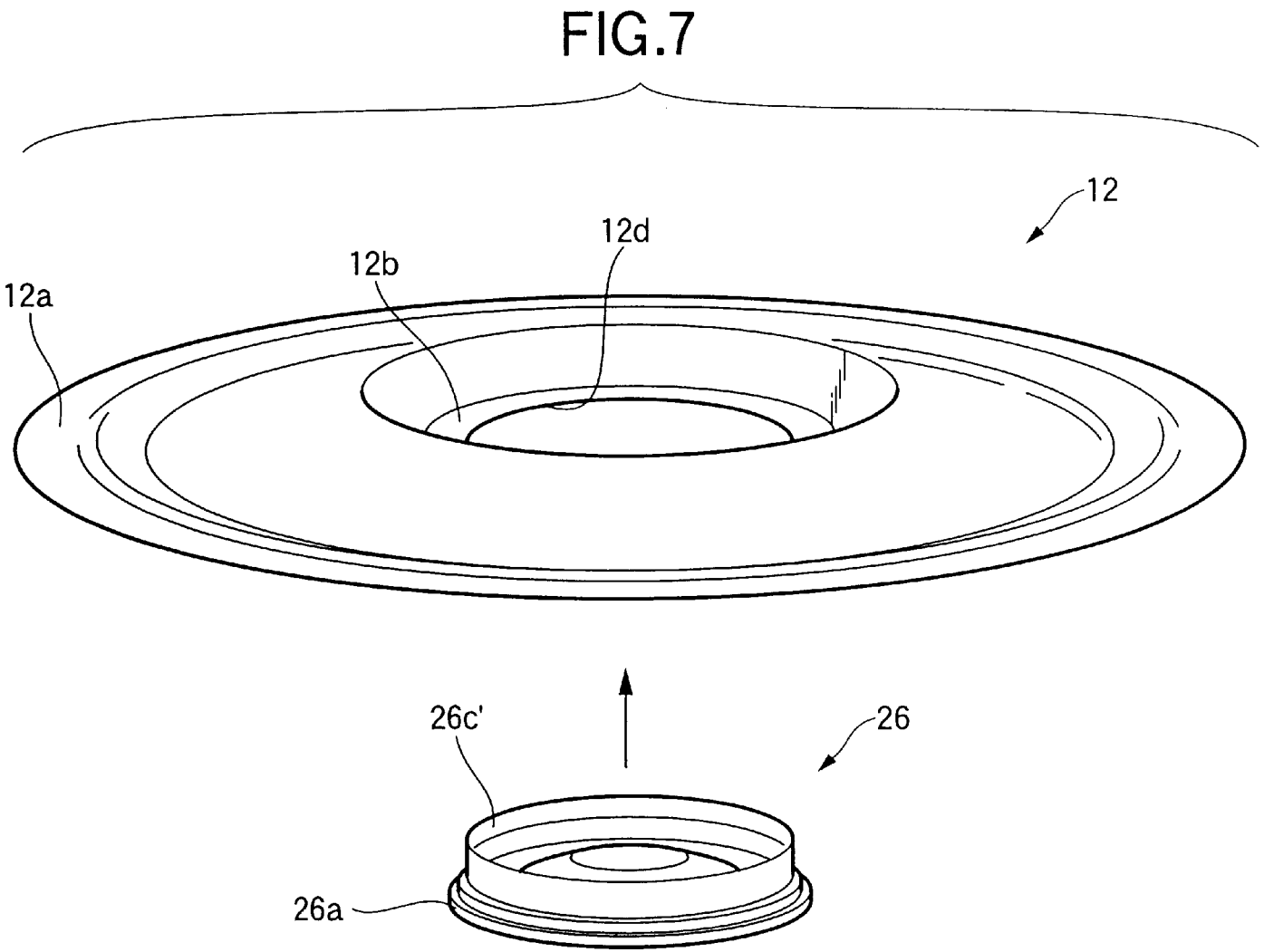
FIG. 7 is a single member perspective view showing a state before a coil supporting member is caulked and fixed to a diaphragm in the second modification.

FIG. 6 is a main portion side sectional view, which shows a second modification of the embodiment; and FIG. 7 is a perspective view of the second modification, which shows a state before a coil supporting member 26 is caulked and fixed to a diaphragm 12.

The second modification is different from the embodiment in the caulk-fixing structure of the coil supporting member 26 to the diaphragm 12.

Namely, in the second modification, an annular rib-shaped caulking projection 26*c*' is formed at the upper end surface of the coil supporting member 26. On the other hand, in the diaphragm 12, an inward part of its central flat portion 12*b* in the radial direction is punched out, and a circular through-hole 12*d* of such a size that it substantially comes into contact with the outside periphery of the caulking projection 26*c*' is formed.

And, after the caulking projection 26*c*' is inserted into the through-hole 12*d* of the diaphragm 12 from the lower side, the caulking projection 26*c*' is subjected to a plastic deformation toward the peripheral side in whole to form a caulk-fixed portion 26*c*, whereby the coil supporting member 26 is fixed to the diaphragm 12. In this case, the plastic deformation of the caulking projection 26*c*' is performed by applying ultrasonic vibration to the caulking projection 26*c*' and subjecting the caulking projection 26*c*' to a heat-deformation.

The coil supporting member 26 in the second modification is not an annular member but a lid member that covers the whole of the through-hole 12*d*. Hereby, the upper and lower spaces of the diaphragm 12 are completely partitioned, and acoustic property of a speaker 10 is maintained.

Also, in case that the constitution in the second modification is adopted, the effects similar to those in the embodiment can be obtained.

Further, in the second modification, since the caulking projection 26*c*' and the through-hole 12*d* are respectively single, when the caulk-fixing is performed, the diaphragm 12 can be readily set to the coil supporting member 26, whereby working efficiency in manufacture of the speaker 10 can be heightened more.

Figure 8:
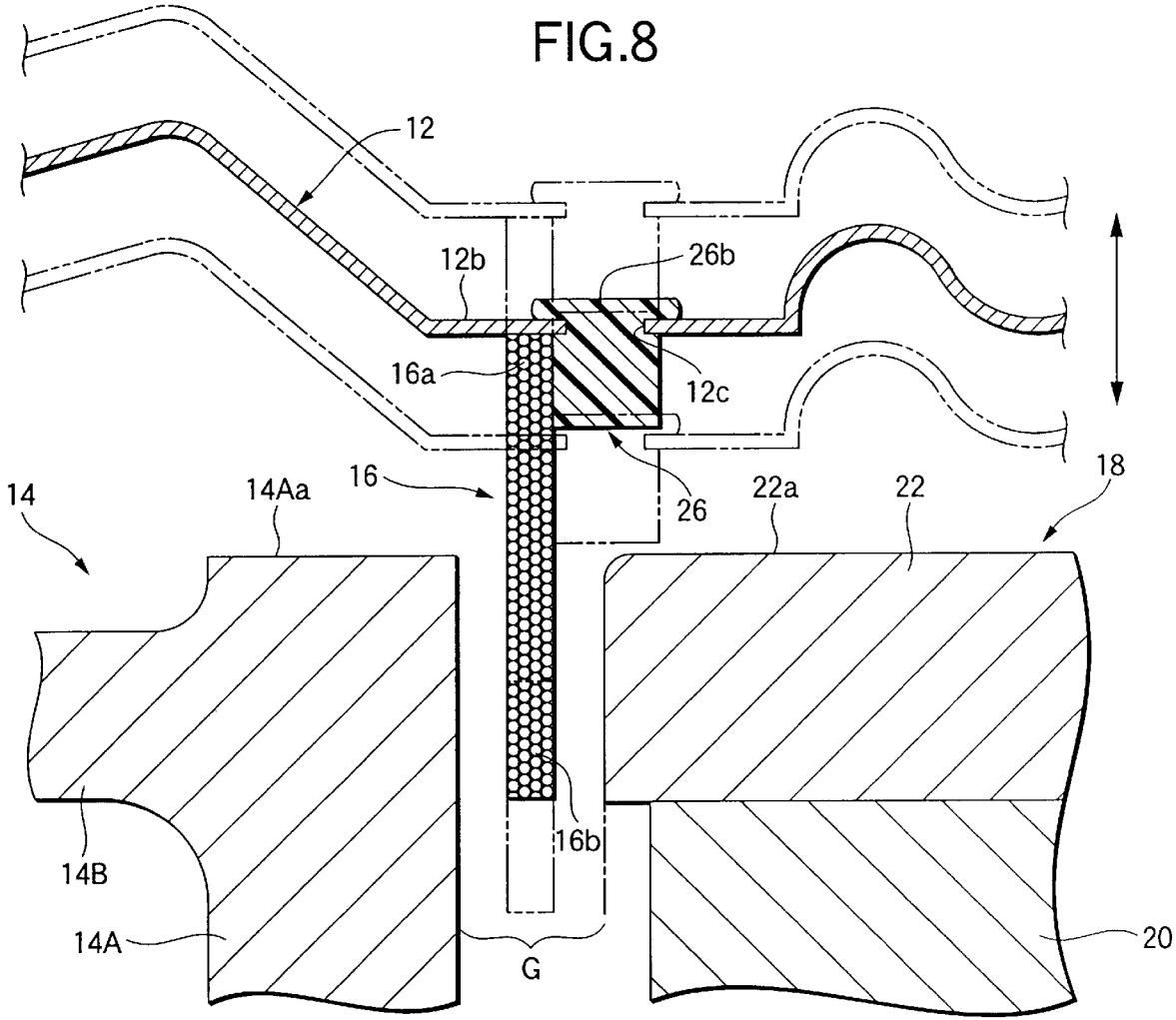
FIG. 8 is a diagram similar to FIG. 2, which shows a third modification of the embodiment.

FIG. 8 is a diagram similar to FIG. 2, which shows a third modification of the embodiment.

The third modification is different from the embodiment in the fixing structure of a voice coil 16 to a diaphragm 12.

Namely, in the third modification, a flange portion 16*a*1 is not formed at an upper end portion 16*a* of the voice coil 16 unlike in the embodiment, and an engaging portion 26*a* is not formed in a coil supporting member 26. And, in the third modification, the voice coil 16 is, at its upper end portion 16*a*, bonded and fixed to both the outer surface of the coil supporting member 26 and a central flat portion 12*b* of the diaphragm 12. However, the third modification is the same as the embodiment in that the coil supporting member 26 is caulked and fixed to the diaphragm 12.

In the third modification, the upper end portion 16*a* of the voice coil 16 is not physically fixed to the diaphragm 12 unlike in the second modification. However, in relation to the diaphragm 12, it is fixed not only directly but also indirectly through the coil supporting member. Therefore, in comparison to the conventional example in which the upper end portion 16*a* of the voice coil 16 is only bonded to the diaphragm directly, its fixing strength can be greatly improved.

In this case, if the required fixing strength of the voice coil 16 in relation to the diaphragm 12 can be obtained by only bonding and fixing the upper end portion 16*a* of the voice coil 16 on the outer surface of the coil supporting member 26, bond-fixing of the voice coil 16 to the diaphragm 12 can be omitted thereby to increase working efficiency in manufacture of the speaker 10.

Figure 9B:
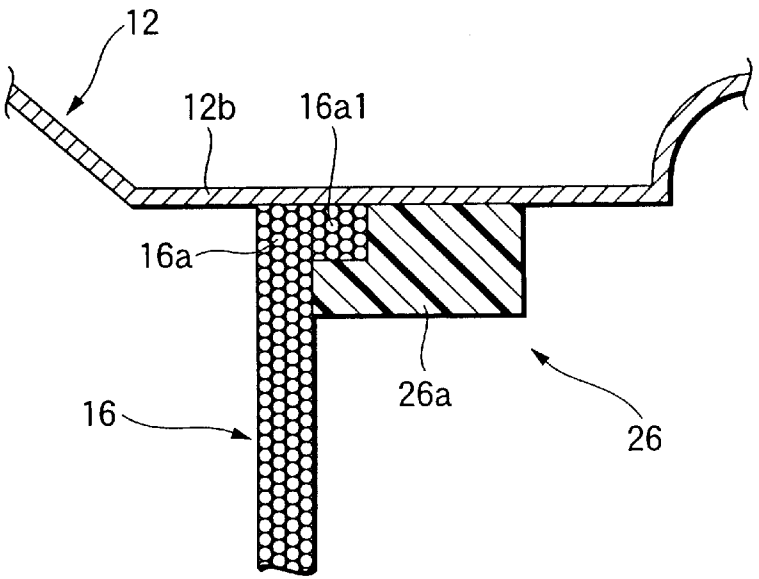
FIGS. 9A and 9B are diagrams similar to FIG. 2, which show fourth and fifth modifications of the embodiment.
Figure 9A:
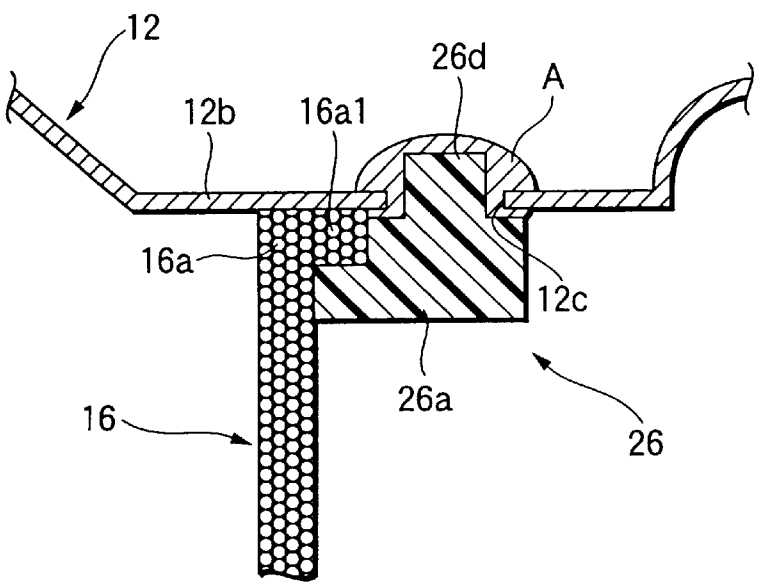
Figure 10B:
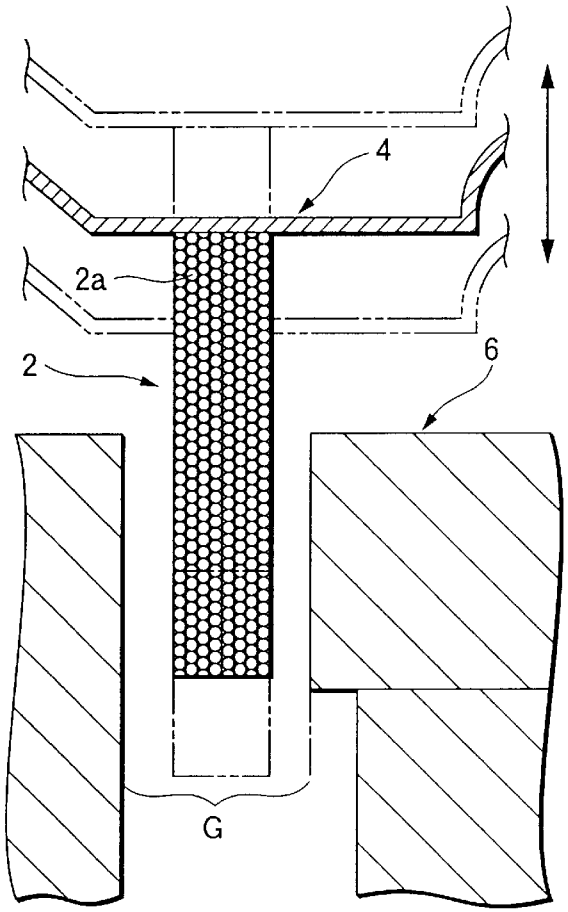
FIGS. 10A and 10B are diagrams similar to FIG. 2, which show a conventional example.
Figure 10A:
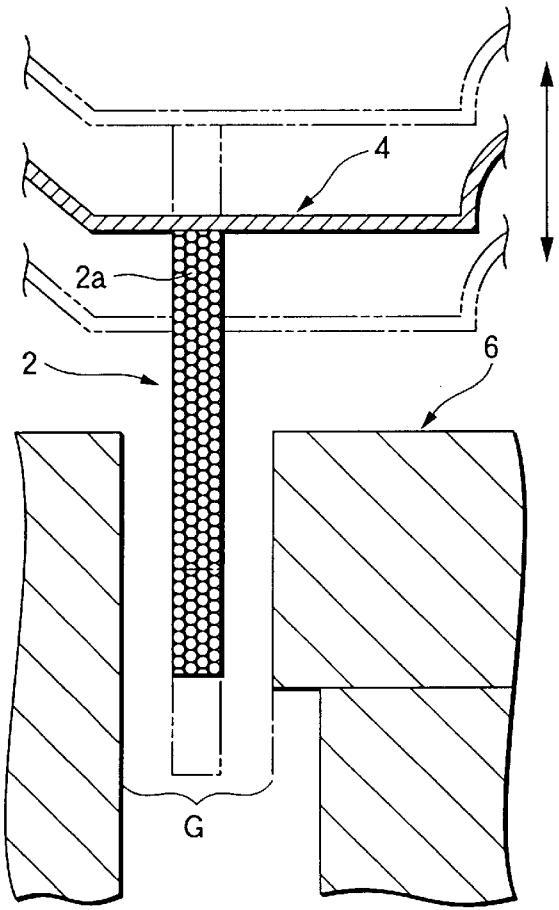

FIGS. 9A and 9B are diagrams similar to FIG. 2, which show a fourth modification and a fifth modification of the embodiment.

These fourth and fifth modifications are different from the embodiment in the fixing structure of a coil supporting member 26 to the diaphragm 12.

Namely, as shown in FIG. 9A, in the fourth modification, at the upper end portion of the coil supporting member 26, a projection 26*d* is formed, which has a little smaller diameter than the diameter of a through-hole 12*c* of the diaphragm 12. In a state where a flange portion 16*a*1 of the voice coil 16 is engaged with an engaging portion 26*a* of the coil supporting member 26, the projection 26*d* is inserted into the through-hole 12*c* from the lower side. Under this state, adhesive A is applied to the surroundings of the projection 26*d,* whereby the coil supporting member 26 is bonded and fixed to a central flat portion 12*b* of the diaphragm 12.

Further, as shown in FIG. 9B, in the fifth modification, in a state where a flange portion 16*a*1 of a voice coil 16 is engaged with an engaging portion 26*a* of a coil supporting member 26, the upper end surfaces of these voice coil 16 and coil supporting member 26 are bonded and fixed to a central flat portion 12*b* of a diaphragm 12.

Also, in case that the constitution as shown in the fourth modification or fifth modification is adopted, in comparison to the conventional example in which the upper end portion 16*a* of the voice coil 16 is only bonded and fixed to the diaphragm 12, the fixing strength of the voice coil 16 to the diaphragm 12 can be greatly improved.

In the embodiment and the first, second, fourth and fifth modifications of the embodiment, the sectional shape of each of the engaging portion 26*a* of the coil supporting member 26 and the flange portion 16*a*1 of the voice coil 16 is set to a rectangular shape. However, if it is possible to prevent the voice coil 16 from separating from the coil supporting member 26 by engaging the flange portion 16*a*1 with the engaging portion 26*a,* the engaging portion 26*a* and the flange portion 16*a*1 may have other sectional shape than this shape. For example, it is possible to set the both sectional shapes to a trapezoid or a triangle, or it is possible to set one sectional shape to a fan-shape and to set the other sectional shape to a shape having an arc-shaped recess portion that fits to the fan-shape.

Further, in the embodiment and each modification, the coil supporting member 26 includes the member made of synthetic resin. However, in the embodiment and the first to third modifications, the coil supporting member 26 may be made of other material than the synthetic resin, for example, of aluminum as long as the caulking projections 26*b*' and 26*c*' can be subjected to the plastic deformation. Further, in case of using aluminum or the like, the ultrasonic vibration cannot be used. However, each of the caulking projections 26*b*' and 26C' can be mechanically subjected to the plastic deformation.

Further, the following constitution may be adopted. The coil supporting member 26 may be formed not as an annular member having the plural caulking projections 26*b*' are formed but as a small piece having a single caulking projection 26*b*' is formed. In this case, each of these plural coil supporting members 26 can be caulk-fixed to each of plural through-holes 12 formed at a central flat portion 12*b* of the diaphragm 12.

In the embodiment and each modification, the case where the speaker 10 is a small-sized speaker is described. However, even in case that it is a larger speaker, by adopting the similar constitution to that in the embodiment and each modification, the similar effects to those in the embodiment and each modification can be obtained.

What is claimed is:

1. A speaker comprising:

a diaphragm;

a magnetic circuit unit defining a cylindrical magnetic gap;

a voice coil having a first portion fixed to the diaphragm, and a second portion placed in the cylindrical magnetic gap; and a coil supporting member, fixed to the diaphragm, for supporting the first portion of the voice coil, wherein the coil supporting member is caulked and fixed to the diaphragm by subjecting a caulking projection formed in the coil supporting member to a plastic deformation, wherein the first portion of the coil has a flange portion protruding inward in the radial direction of the magnetic circuit, wherein the coil supporting member has an engaging portion for engaging with the flange portion, and wherein the flange portion is sandwiched between the diaphragm and the engaging portion from an upper side and an under side thereof.

2. The speaker according to claim 1 wherein the coil supporting member is made of synthetic resin; and the plastic deformation is performed by applying ultrasonic vibration to the caulking projection and subjecting the caulking projection to a heat deformation.

3. A The speaker according to claim 2 wherein the coil supporting member is an annular member;

the caulking projection comprises a plurality of caulking projections formed at different positions in the coil supporting member at a predetermined interval in the circumferential direction; and a plurality of through-holes are defined in the diaphragm, into which the plurality of caulking projections are inserted.

4. The speaker according to claim 1 wherein the coil supporting member is an annular member;

the caulking projection comprises a plurality of caulking projections formed at different positions in the coil supporting member at a predetermined interval in the circumferential direction; and a plurality of through-holes are defined in the diaphragm, into which the plurality of caulking projections are inserted.

5. A speaker comprising:

a diaphragm;

a magnetic circuit defining cylindrical magnetic gap;

a voice coil having a first portion fixed to the diaphragm and a second portion placed in the cylindrical magnetic gap; and a coil supporting member, fixed to the diaphragm, for supporting the first portion of the voice coil, wherein a flange portion protruding inward in the radial direction of the diaphragm is formed at the first portion of the voice coil, wherein an engaging portion for engaging with the flange portion is formed in the coil supporting member, and the flange portion is sandwiched by the diaphragm and the engaging portion from an upper side and an under side thereof.

6. The speaker as claimed in claim 5, wherein the coil supporting member is fixed to the diaphragm by bonding.

* * * * *